US010016881B2

(12) United States Patent
Aoyagi

(10) Patent No.: US 10,016,881 B2
(45) Date of Patent: Jul. 10, 2018

(54) ROTARY TOOL

(71) Applicant: TJM DESIGN CORPORATION, Tokyo (JP)

(72) Inventor: Chihiro Aoyagi, Tokyo (JP)

(73) Assignee: TJM Design Corporation, Tokyo (JP)

( * ) Notice: Subject to any disclaimer, the term of this patent is extended or adjusted under 35 U.S.C. 154(b) by 420 days.

(21) Appl. No.: 14/977,303

(22) Filed: Dec. 21, 2015

(65) Prior Publication Data

US 2016/0176027 A1 Jun. 23, 2016

(30) Foreign Application Priority Data

Dec. 22, 2014 (JP) ..... 2014-259246

(51) Int. Cl.
*B25B 21/02* (2006.01)
*B25B 21/00* (2006.01)

(52) U.S. Cl.
CPC ..... *B25B 21/026* (2013.01); *B25B 21/00* (2013.01); *B25B 21/02* (2013.01)

(58) Field of Classification Search
CPC ..... B25B 21/00; B25B 21/02; B25B 21/026; B25D 15/02
USPC ..... 173/93, 93.5, 93.6, 93.7, 205; 81/466
See application file for complete search history.

(56) References Cited

U.S. PATENT DOCUMENTS 4,313,505 A * 2/1982 Silvern ..... B25B 21/026 173/93.5
7,712,546 B2 * 5/2010 Tokunaga ..... B25B 21/00 173/146
8,490,714 B2 * 7/2013 Nakamura ..... B25B 21/00 173/93
2001/0010268 A1 * 8/2001 Tokunaga ..... B25B 21/02 173/205
2006/0024141 A1 * 2/2006 Schad ..... B25B 21/026 408/8
2012/0073845 A1 * 3/2012 Nakamura ..... B25B 21/026 173/93.5

FOREIGN PATENT DOCUMENTS

JP 2010-280021 A 12/2010

* cited by examiner

*Primary Examiner* — Scott A. Smith
(74) *Attorney, Agent, or Firm* — Studebaker & Brackett PC

(57) ABSTRACT

A rotary tool includes a driving power source, a spindle formed in a columnar shape extending to a first side of an axial direction, a main hammer including a hammer pawl, an anvil including an anvil pawl engageable with the hammer pawl, a cylindrical secondary hammer disposed so as to cover an outer circumference of the main hammer, a round-columnar pin having an end portion on a second side of the axial direction positioned between the main hammer and the secondary hammer, an impacting mechanism disposed on the spindle so as to support the main hammer, and a casing. At least one end portion of the pin in the axial direction is supported in a radial direction of the pin by at least one of the spindle or the casing in such a manner that a rotation axis of the secondary hammer coincides with a rotation axis of the spindle.

4 Claims, 6 Drawing Sheets

Fig.4A
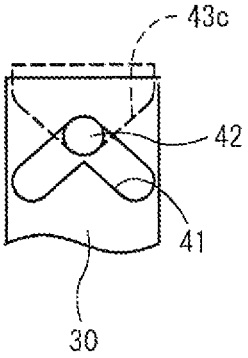
Fig.4B
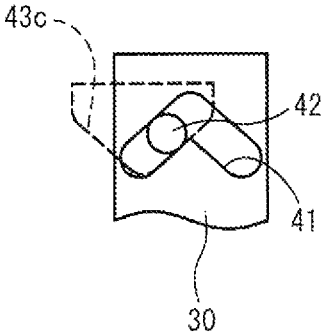
Fig.4C
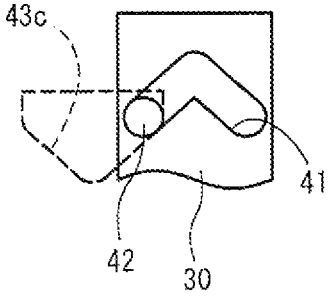
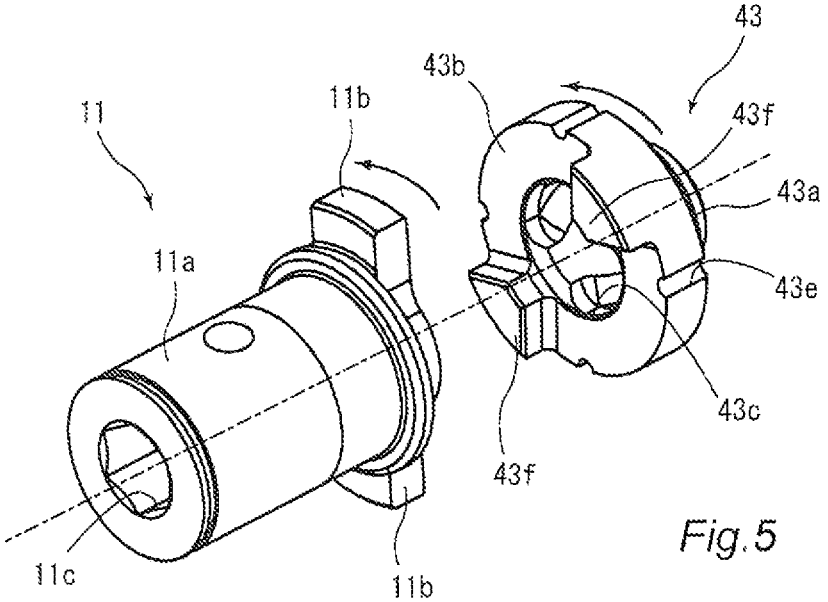
Fig.5

ROTARY TOOL

BACKGROUND OF THE INVENTION

1. Field of the Invention

The present invention relates to a rotary tool that is capable of firmly fastening bolts or other devices by exerting an impact force on an anvil, to which the tool or another device is attached, in a rotational direction.

2. Description of the Related Art

To date, a rotary tool is known that is capable of firmly fastening bolts or other devices by exerting an impact force on an anvil, to which the tool or another device is attached, in a rotational direction. For example, Japanese Unexamined Patent Application Publication No. 2010-280021 discloses, in FIG. 1, a rotary tool that includes a spindle rotated by a motor, a main hammer disposed at one end portion of the spindle in an axial direction, a secondary hammer disposed so as to cover the outer circumference of the main hammer, and an anvil disposed on the outer side of the main hammer in the axial direction. In the configuration disclosed in FIG. 1 of Japanese Unexamined Patent Application Publication No. 2010-280021, the main hammer is rotatable together with the spindle and movable relative to the spindle in the axial direction. The main hammer includes first pawls and the anvil includes second pawls engageable with the first pawls.

In the above-described configuration, when a torque exceeding a predetermined value is transmitted from the spindle to the main hammer, an impact force is exerted on the anvil in the rotational direction by moving the main hammer toward the anvil while rotating the main hammer to cause the first pawls of the main hammer to become engaged with the second pawls of the anvil with an impact.

Here, in the configuration disclosed in FIG. 1 of Japanese Unexamined Patent Application Publication No. 2010-280021, the secondary hammer is connected to the main hammer with needle rollers interposed therebetween so as to rotate together with the main hammer and allow the main hammer to move in the axial direction. Here, the needle rollers are rotatably disposed in semicircular grooves formed in the main hammer and the secondary hammer.

In such a rotary tool having the above-described configuration, the rotation axis of the secondary hammer has to coincide with the rotation axis of the spindle for vibration reduction. Thus, as illustrated in FIG. 1 of Japanese Unexamined Patent Application Publication No. 2010-280021, a configuration is known in which the rotation axis of the secondary hammer and the rotation axis of the spindle are made coincide with each other as a result of moving an inner circumferential portion of the cylindrical secondary hammer so as to slide over the outer circumferential surface of the spindle.

However, in the configuration such as the one described above in which the inner circumferential portion of the secondary hammer is moved to slide over the outer circumferential surface of the spindle, the sliding portion wears away. This wearing away may adversely affect the performance or the life of the tool.

A configuration made to address this problem is known as illustrated in, for example, FIG. 5 of Japanese Unexamined Patent Application Publication No. 2010-280021, in which the rotation axis of the secondary hammer is made coincide with the rotation axis of the spindle by supporting the cylindrical secondary hammer with a bearing. Specifically, in the configuration disclosed in FIG. 5 of Japanese Unexamined Patent Application Publication No. 2010-280021, the rotation axis of the secondary hammer and the rotation axis of the spindle are made coincide with each other by causing the inner circumference of the casing to support the outer circumferential surface of the cylindrical secondary hammer using a bearing.

In the configuration in which the inner circumference of the casing is caused to support the outer circumferential surface of the cylindrical secondary hammer using a bearing, as in the configuration illustrated in FIG. 5 of Japanese Unexamined Patent Application Publication No. 2010-280021, the number of components increases due to the need of a bearing and the size of the rotary tool increases with increasing length of the rotary tool in the axial direction of the spindle.

On the other hand, a configuration for forming a compact rotary tool is conceivable by reducing the size of the main hammer and the secondary hammer. Reducing the size of the main hammer and the secondary hammer in this manner, however, would reduce the impact torque applied to the anvil, thereby reducing the fastening torque of the rotary tool.

SUMMARY OF THE INVENTION

Accordingly, it is an object of the present invention to provide a rotary tool that includes a secondary hammer disposed so as to cover a main hammer and that exerts an impact force on an anvil in the rotational direction using the main hammer, the rotary tool having a compact configuration with fewer components while ensuring a sufficient fastening torque.

A rotary tool according to an embodiment of the invention includes a driving power source, a spindle, a main hammer, an anvil, a cylindrical secondary hammer, a round-columnar pin, an impacting mechanism, and a casing. The spindle is formed in a columnar shape extending to a first side of an axial direction and rotated by an output from the driving power source. The main hammer includes a hammer pawl protruding to a second side of the axial direction and is fitted to an end portion of the spindle on the second side of the axial direction so as to be rotatable together with the spindle and movable in the axial direction relative to the spindle. The anvil includes an anvil pawl engageable with the hammer pawl and is disposed on the end portion of the spindle on the second side of the axial direction in such a manner that a rotation axis of the anvil is aligned with a rotation axis of the spindle. The secondary hammer disposed so as to cover an outer circumference of the main hammer. The round-columnar pin having an end portion on the second side of the axial direction positioned between the main hammer and the secondary hammer so as to allow the secondary hammer to rotate together with the main hammer and allow the main hammer and the secondary hammer to move in the axial direction relative to each other. The impacting mechanism is disposed on the spindle so as to support the main hammer. The impacting mechanism exerts an impact in a rotational direction on the anvil pawl of the anvil using the hammer pawl of the main hammer by moving the main hammer in the axial direction while rotating the main hammer when a load torque having a predetermined value or higher is applied to the main hammer. The casing accommodates the spindle, the main hammer, the secondary hammer, the anvil, the pin, and the impacting mechanism. At least one of end portions of the pin in the axial direction is supported in a radial direction of the pin by at least one of the spindle or the casing in such a manner that a rotation axis of the secondary hammer coincides with the rotation axis of the spindle (first configuration).

BRIEF DESCRIPTION OF THE DRAWINGS

FIGS. 4A to 4C schematically illustrate a cam groove of a spindle of the impact driver according to the first embodiment and a movement of a steel ball disposed in the cam groove of a main hammer;

FIG. 5 is a perspective view of a schematic configuration of the main hammer and an anvil of the impact driver according to the first embodiment;

DESCRIPTION OF THE PREFERRED EMBODIMENTS

Figure 1:
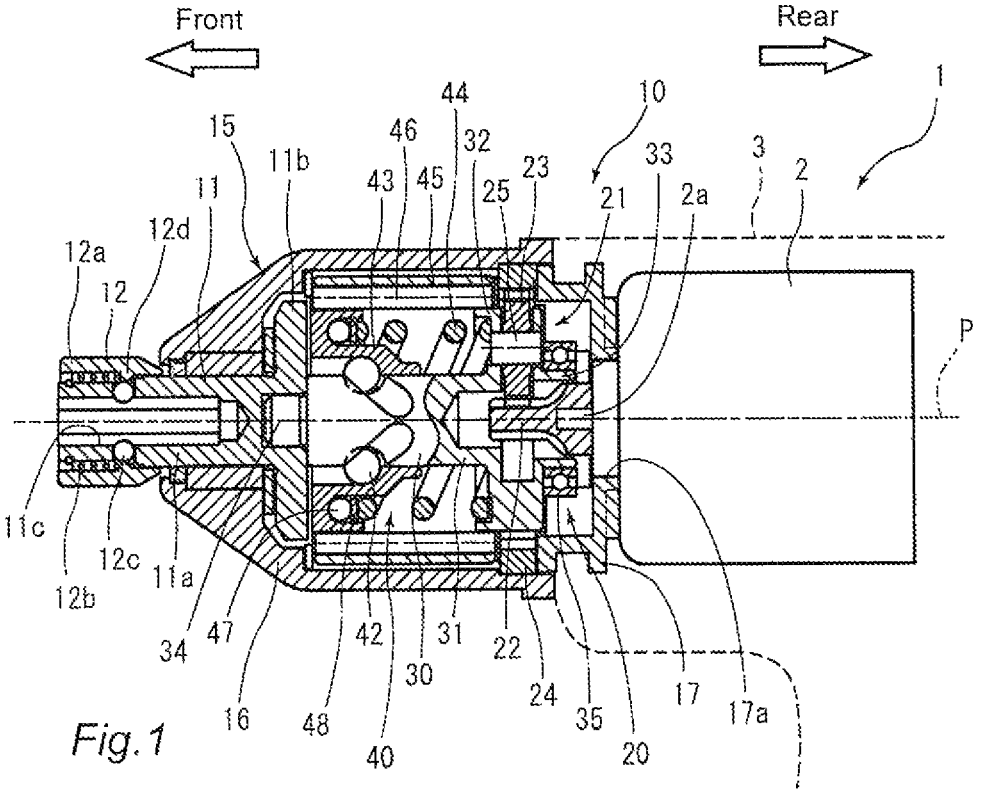
FIG. 1 is a cross-sectional view of a schematic configuration of an impact driver according to a first embodiment of the invention.

Referring now to the drawings, embodiments of the invention are described in detail. Throughout the drawings, the dimensions of components are not expressed faithfully to the dimensions of the actual components, the dimensional ratios of the components, or other parameters.

First Embodiment

Overall Configuration

FIG. 1 is a cross-sectional view of a schematic configuration of an impact driver 1 serving as a rotary tool according to a first embodiment of the invention. The impact driver 1 rotates a tool (not illustrated) called a bit attached to an anvil 11 using a rotational driving power acquired from a motor 2 (driving power source) to exert a rotational impact force on devices such as a bolt or a nut.

FIG. 1 only illustrates a driving portion in the impact driver 1 and omits illustrations of other portions of the impact driver 1. The impact driver 1 according to the embodiment has a configuration similar to that of a typical power tool except for the configuration of the driving portion. Thus, the following describes only the driving portion of the impact driver 1. In the following description, the left side in FIG. 1 is referred to as the front of the impact driver (or, simply, the front) and the right side in FIG. 1 is referred to as the rear of the impact driver (or, simply, the rear).

The impact driver 1 includes a motor 2, a driving mechanism 10 driven by the motor 2, and a housing 3 that covers the motor 2 and that is attached to the driving mechanism 10. Although a specific description of the housing 3 is omitted, the housing 3 includes components including a grip that an operator grips and a lever, serving as an on-off control switch of the motor 2, as in the case of an impact driver having a typical configuration.

The motor 2 is a direct-current motor driven by direct current supplied from a power source such as a rechargeable battery, not illustrated. An operation on a lever, not illustrated, included in the housing 3 controls a supply of direct current from the rechargeable battery to the motor 2. Specifically, an operation on the lever of the housing 3 controls a start or stop of rotation of the motor 2. The configuration of the motor 2 is similar to that of a typical direct-current motor and is thus not described in detail.

The motor 2 has an output shaft 2*a*. The output shaft 2*a* rotates together with a rotor of the motor 2, not illustrated, and outputs the rotational driving power of the motor 2 to the outside of the motor 2. A sun gear 22 of a planetary gear mechanism 21, described below, is attached to the output shaft 2*a*.

The driving mechanism 10 includes an anvil 11, a rotation transmission mechanism 20 that transmits the rotational driving power of the motor 2 to the anvil 11, and a casing 15 that accommodates the anvil 11 and the rotation transmission mechanism 20. The anvil 11 is a substantially cylindrical member made of steel. A chuck 12 disposed for attachment of a bit, not illustrated, is disposed at an end portion of the anvil 11. The driving mechanism 10 transmits the rotational driving power output from the motor 2 to the anvil 11 via the rotation transmission mechanism 20 to rotate a bit, not illustrated, fixed to the chuck 12 located at the end of the anvil 11.

The casing 15 forms a space for accommodating the anvil 11 and the rotation transmission mechanism 20. Specifically, the casing 15 includes a substantially cylindrical casing body 16 and a casing cover 17 connecting the rear of the casing body 16 and the motor 2 together. The casing body 16 has a conical shape in which the outer diameter of the front side gradually decreases toward the front. The anvil 11 is accommodated inside the front portion of the casing body 16. The casing cover 17 is disposed so as to cover a rear opening of the casing body 16. The motor 2 is disposed at the rear of the casing cover 17. A through hole 17*a* that allows the output shaft 2*a* of the motor 2 to be inserted therethrough is formed in a middle portion of the casing cover 17.

Figure 2:
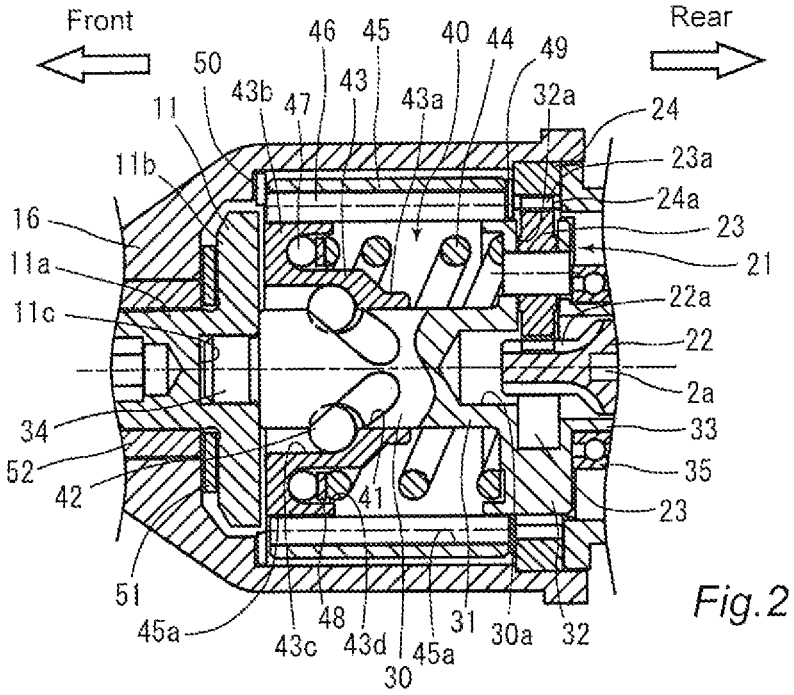
FIG. 2 is an enlarged cross-sectional view of a rotation transmission mechanism of the impact driver according to the first embodiment.

The rotation transmission mechanism 20 includes a planetary gear mechanism 21, a spindle 30, and an impacting mechanism 40. FIG. 2 illustrates the rotation transmission mechanism 20 in an enlarged manner. In FIG. 2, as in the case of FIG. 1, the left side in FIG. 2 is referred to as the front of the impact driver (or, simply, the front) and the right side in FIG. 2 is referred to as the rear of the impact driver (or, simply, the rear).

Figure 3:
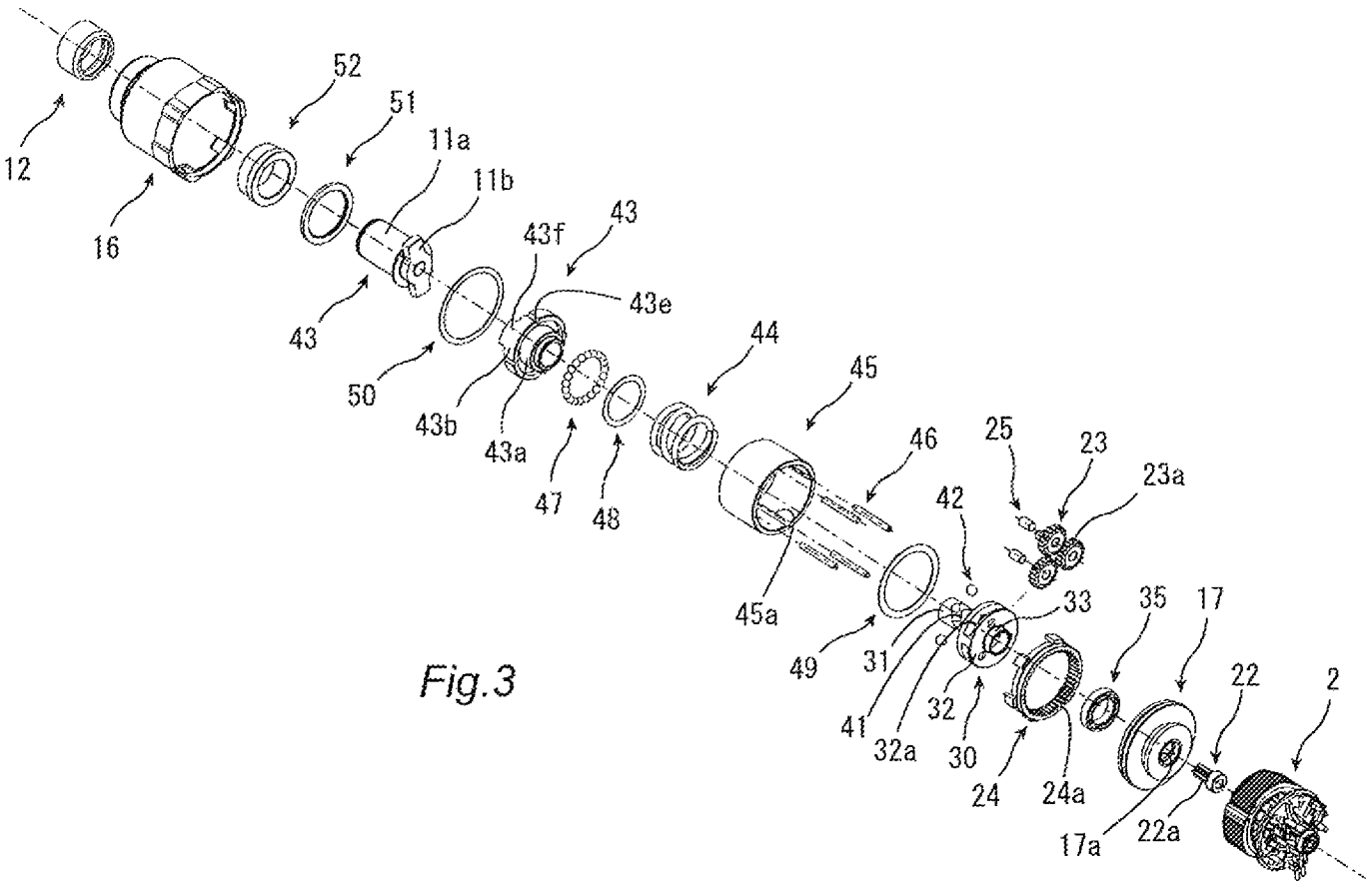
FIG. 3 is an exploded perspective view in which components of a driving portion of the impact driver according to the first embodiment are illustrated in an exploded manner.

As illustrated in FIG. 1 and FIG. 2, the planetary gear mechanism 21 includes a round-columnar sun gear 22, three planetary gears 23 that engage with the sun gear 22, and an internal gear 24 that engages with the three planetary gears 23. The sun gear 22 is a round-columnar member made of steel. The output shaft 2*a* of the motor 2 is connected to one end portion of the sun gear 22. The sun gear 22 has multiple external teeth 22*a*, which engage with the planetary gears 23, on the outer circumferential surface of the other end portion. As illustrated in FIG. 3, these external teeth 22*a* are disposed at predetermined intervals in the circumferential direction of the sun gear 22 and extend in the axial direction.

The number of planetary gears 23 here may be two, four, or greater than four.

As illustrated in FIG. 1 and FIG. 3, the planetary gears 23 are round-columnar members made of steel and each have multiple external teeth 23*a* on its outer circumferential surface. The three planetary gears 23 are arranged so as to surround the sun gear 22. Each of the planetary gears 23 is rotatably supported on a large diameter portion 32 of the spindle 30, described below, by a pin 25. Specifically, as described below, three recesses 32*a* that can individually accommodate the three planetary gears 23 are formed in the outer circumferential surface of the large diameter portion 32 of the spindle 30 (see FIG. 3). Each of the planetary gears 23 is rotatably supported by the corresponding pin 25 fixed to the large diameter portion 32 while being disposed in the corresponding recess 32*a* of the large diameter portion 32 of the spindle 30.

As illustrated in FIG. 1 to FIG. 3, the internal gear 24 is a cylindrical steel member. The internal gear 24 has multiple internal teeth 24*a* on its inner circumferential surface. The internal gear 24 has its outer circumferential surface fixed to the casing body 16 of the casing 15 so as to allow the three planetary gears 23 to be disposed inside the internal gear 24 (see FIG. 1 and FIG. 2). The external teeth 23*a* of the three planetary gears 23 engage with the internal teeth 24*a* on the inner circumferential surface of the internal gear 24.

In the above-described configuration of the planetary gear mechanism 21, the rotational driving power output from the output shaft 2*a* of the motor 2 is transmitted to the spindle 30 via the sun gear 22, the planetary gears 23, and the pins 25. The rotation output from the motor 2 is thus decelerated by the planetary gear mechanism 21 and transmitted to the spindle 30.

The spindle 30 is a substantially round-columnar member made of steel and extending in the axial direction. Specifically, as illustrated in FIG. 1 to FIG. 3, the spindle 30 includes a small diameter portion 31 and a large diameter portion 32 disposed so as to be integrated with the small diameter portion 31. The large diameter portion 32 is disposed on a first side of the axial direction of the small diameter portion 31 (on a side closer to the motor 2, that is, on the rear side of the impact driver 1 in this embodiment). As illustrated in FIG. 1 and FIG. 2, the spindle 30 has a bearing support portion 33 on the first side of the axial direction of the large diameter portion 32, the bearing support portion 33 having a smaller diameter than the large diameter portion 32 and being rotatably supported by a bearing 35. Thus, the first side of the spindle 30 is rotatably supported by the bearing 35.

As illustrated in FIG. 2, an insertion hole 30*a* extending in the axial direction of the spindle 30 is formed at the end portion of the spindle 30 on the first side of the axial direction. The insertion hole 30*a* has a length substantially half the length of the spindle 30 in the axial direction. Specifically, the insertion hole 30*a* is formed so as to extend from the end of the spindle 30 on the first side of the axial direction toward a second side of the axial direction of the spindle 30 beyond the large diameter portion 32. The insertion hole 30*a* has such a diameter that the sun gear 22 of the planetary gear mechanism 21 can be accommodated in the insertion hole 30*a*.

As illustrated in FIG. 3, the large diameter portion 32 has a disk-like shape and has three recesses 32*a* formed on the outer circumferential surface and extending radially inward. Each recess 32*a* is so sized as to be capable of accommodating the corresponding planetary gear 23 of the planetary gear mechanism 21. As illustrated in FIG. 2, each recess 32*a* is formed so as to be continuous with the insertion hole 30*a* formed in the spindle 30. Thus, each of the planetary gears 23 disposed in the corresponding recess 32*a* of the large diameter portion 32 and the sun gear 22 disposed in the insertion hole 30*a* of the spindle 30 are allowed to engage with each other inside the spindle 30.

As illustrated in FIG. 2, a pair of cam grooves 41 are formed in the outer circumferential surface of the small diameter portion 31. The cam grooves 41 constitute part of the impacting mechanism 40, described below. When the small diameter portion 31 is viewed in a direction perpendicular to the axial direction of the spindle 30, each cam groove 41 is formed in a substantially V shape such that a bent portion is located on the front of the impact driver 1. Each cam groove 41 has a semicircular cross section. As described below, in each cam groove 41, a steel ball 42 constituting part of the impacting mechanism 40 is movably disposed.

As illustrated in FIG. 1 and FIG. 2, a protruding portion 34 having a smaller diameter than the small diameter portion 31 is disposed at the end of the small diameter portion 31 on the second side of the axial direction of the spindle 30. The protruding portion 34 is formed so as to protrude toward the second side of the axial direction of the spindle 30 and so as to be integrated with the small diameter portion 31. The protruding portion 34 is inserted into an insertion hole 11*c* formed in the anvil 11, described below, while being allowed to rotate.

The impacting mechanism 40 is a mechanism that exerts an impact force on the anvil 11 in the rotational direction using a cylindrical main hammer 43 by rotating the main hammer 43 while moving the main hammer 43 in the axial direction following the rotation of the spindle 30. Specifically, the impacting mechanism 40 includes the above-described pair of cam grooves 41 formed on the outer circumferential surface of the small diameter portion 31 of the spindle 30, steel balls 42 disposed in the respective cam grooves 41, the main hammer 43 that moves in the axial direction with respect to the spindle 30 in response to a movement of the steel balls 42 inside the cam grooves 41, a spring 44 that elastically supports the main hammer 43, a cylindrical secondary hammer 45 disposed so as to cover the main hammer 43, and multiple pins 46 disposed between the secondary hammer 45 and the main hammer 43.

As illustrated in FIG. 1 and FIG. 2, the main hammer 43 is a substantially cylindrical member made of steel. The main hammer 43 is fitted onto the outer circumferential surface of the spindle 30 so as to be movable in the axial direction of the spindle 30. The main hammer 43 is disposed at the end of the spindle 30 on the second side of the axial direction. As illustrated in FIG. 2, the main hammer 43 includes a hammer slidable portion 43*a*, which slides over the outer circumferential surface of the spindle 30, and a hammer-large-diameter portion 43*b*, located on the front side of the hammer slidable portion 43*a*. The hammer slidable portion 43*a* and the hammer-large-diameter portion 43*b* are formed as an integrated unit.

A pair of cam grooves 43*c* are formed in the inner circumferential surface of the hammer-large-diameter portion 43*b*. FIGS. 4A to 4C are expansion plans of each cam groove 43*c* formed in the hammer-large-diameter portion 43*b* of the main hammer 43 and the corresponding cam groove 41 formed in the small diameter portion 31 of the spindle 30. As illustrated in FIGS. 4A to 4C, when the hammer-large-diameter portion 43*b* is viewed from the inside, the pair of cam grooves 43*c* are each formed in a triangular shape that protrudes toward the rear of the impact driver 1. Each cam groove 43*c* has a depth equivalent to the radius of the steel balls 42. The steel balls 42 positioned in the cam grooves 41 of the spindle 30 are also positioned in the cam grooves 43*c*. Specifically, each of the steel balls 42 is positioned in the corresponding cam groove 41 of the spindle 30 and the corresponding cam groove 43*c* of the main hammer 43 and moves along the cam groove 41 and the cam groove 43*c*.

Specifically, when a bolt or a nut is to be fastened, in the case as illustrated in FIG. 4A where a load torque applied to the anvil 11 is small, the steel ball 42 is positioned at the rear of the cam groove 43*c* of the main hammer 43 and at the bend portion of the V-shaped cam groove 41 of the spindle 30. Then, when the load torque applied to the anvil 11 is increased, the spindle 30 moves relative to the main hammer 43 and, as illustrated in FIG. 4B, the cam groove 43*c* of the main hammer 43 and the cam groove 41 of the spindle 30 are shifted in the rotational direction of the spindle 30 (laterally in FIG. 4). When the main hammer 43 rotates relative to the spindle 30 against the urging force of the spring 44, the steel ball 42 moves toward one end portion of the V-shaped cam groove 41, as illustrated in FIG. 4B. In correspondence with such a movement of the steel ball 42, the main hammer 43 also moves toward the rear of the impact driver 1, as illustrated in FIGS. 4B and 4C. Such a movement of the main hammer 43 causes hammer pawls 43*f* of the main hammer 43 and anvil pawls 11*b* of the anvil 11 to become disengaged from one another. The hammer pawls 43*f* and the anvil pawls 11*b* are described below. Thereafter, the main hammer 43 moves toward the front of the impact driver 1 due to the urging force of the spring 44 and the hammer pawls 43*f* of the main hammer 43 impact the anvil pawls 11*b* of the anvil 11. Such a rotation impact operation of the main hammer 43 and the anvil 11 is described below.

As illustrated in FIG. 2, a groove 43*d* in which multiple steel balls 47 for supporting one end side of the spring 44 are disposed is formed at the rear of the hammer-large-diameter portion 43*b*. When viewed in the axial direction of the spindle 30, the groove 43*d* is formed in a circular shape. The multiple steel balls 47 are circularly arranged in the groove 43*d*. One end side of the spring 44 is supported by the multiple steel balls 47 with a doughnut-shaped washer 48 interposed therebetween. Since one end side of the spring 44 is thus supported by the multiple steel balls 47, the spring 44 and the main hammer 43 are allowed to rotate relative to each other.

As illustrated in FIG. 3, multiple guide grooves 43*e* extending in the axial direction of the main hammer 43 are formed in the outer circumferential surface of the hammer-large-diameter portion 43*b*. In this embodiment, four guide grooves 43*e* are formed at equal intervals in the outer circumferential surface of the hammer-large-diameter portion 43*b*. These guide grooves 43*e* have a semicircular cross section so as to allow the pins 46 to be disposed therein.

As illustrated in FIG. 3 and FIG. 5, the hammer-large-diameter portion 43*b* includes a pair of hammer pawls 43*f* protruding toward the front of the impact driver 1 (toward the second side in the axial direction of the spindle 30). Specifically, as illustrated in FIG. 5, the pair of hammer pawls 43*f* are disposed on the front surface of the hammer-large-diameter portion 43*b* at positions opposing each other with the center of the hammer-large-diameter portion 43*b* interposed therebetween. Specifically, the pair of hammer pawls 43*f* are disposed at intervals of 180 degrees when the hammer-large-diameter portion 43*b* is viewed from the front of the impact driver. When the pair of hammer pawls 43*f* are disposed in this manner, the hammer pawls 43*f* of the main hammer 43 touch the anvil pawls 11*b* of the anvil 11 at intervals of a rotational angle of 180 degrees when the main hammer 43 rotates once. This operation is described in detail below.

When the hammer-large-diameter portion 43*b* is viewed from the front of the impact driver 1, the pair of hammer pawls 43*f* have a substantially triangular shape such that the width decreases toward the inner side of the hammer-large-diameter portion 43*b*.

As illustrated in FIG. 1 and FIG. 2, the spring 44 is a compression spring and has an inner diameter that is larger than the outer diameter of the small diameter portion 31 of the spindle 30. The spring 44 is disposed so as to surround the small diameter portion 31 of the spindle 30. Specifically, the small diameter portion 31 of the spindle 30 is disposed on the inner side of the spring 44. One end side of the spring 44 is supported by the main hammer 43, whereas the other end side of the spring 44 is supported by the front side of the large diameter portion 32 of the spindle 30.

The secondary hammer 45 is a substantially cylindrical member and disposed on the outer circumferential side of the main hammer 43. The secondary hammer 45 has an inner diameter larger than the main hammer 43 and an axial length equivalent to the small diameter portion 31 of the spindle 30. As illustrated in FIGS. 2 and 3, four guide grooves 45*a* are formed on the inner circumferential surface of the secondary hammer 45 at equal intervals in the circumferential direction. When the secondary hammer 45 is disposed on the main hammer 43 in the state as illustrated in FIG. 1, these guide grooves 45*a* are located at positions that correspond to the guide grooves 43*e* formed on the outer circumferential surface of the hammer-large-diameter portion 43*b* of the main hammer 43. Each guide groove 45*a* has such a semicircular cross section as to allow part of the pin 46 to be accommodated therein. This configuration in which the pins 46 are disposed in the guide grooves 43*e* of the main hammer 43 and the guide grooves 45*a* of the secondary hammer 45 allows the secondary hammer 45 to move relative to the main hammer 43 in the axial direction.

As illustrated in FIG. 2, the secondary hammer 45 has its rear side touching the side surface of the internal gear 24 of the planetary gear mechanism 21 with a washer 49 interposed therebetween and has its front side held by the casing body 16 of the casing 15 with a washer 50 interposed therebetween.

The pins 46 are round-columnar members made of steel. In this embodiment, four pins 46 are arranged between the main hammer 43 and the secondary hammer 45. The pins 46 have an axial length equivalent to the secondary hammer 45.

The first end portions (end portions on the second side of the axial direction of the spindle 30) of the pins 46 are supported by the inner surfaces of the guide grooves 43*e* of the main hammer 43 and the inner surfaces of the guide grooves 45*a* of the secondary hammer 45. The second end portions (end portions on the first side of the axial direction of the spindle 30) of the pins 46 are supported by the outer circumferential surface of the large diameter portion 32 of the spindle 30 and the inner surfaces of the guide grooves 45*a* of the secondary hammer 45. Since the secondary hammer 45 is supported by the pins 46 supported in this manner, the secondary hammer 45 can be supported so that the rotation axis of the secondary hammer 45 coincides with the rotation axis P of the spindle 30.

Since the pins 46 have their both ends supported in the above-described manner, the pins 46 are disposed in such a manner as to touch the secondary hammer 45 only at the inner circumferential surface, whereby the pins 46 support the secondary hammer 45 from the inner side in the radial direction. This configuration thus allows the secondary hammer 45 to have a largest possible outer diameter, whereby the moment of inertia of the secondary hammer 45 can be increased as much as possible.

Moreover, this configuration dispenses with a bearing for supporting the secondary hammer 45 since the secondary hammer 45 can be supported by the pins 46 while having their both end portions supported in the above-described manner. This omission of a bearing contributes to the size reduction of the impact driver 1.

As illustrated in FIG. 1 to FIG. 3, the anvil 11 is disposed so that its rotation axis is aligned with the rotation axis P of the spindle 30. The anvil 11 includes a round-columnar chuck connection portion 11*a*, having an end to which the chuck 12 is connected, and a pair of anvil pawls 11*b* that protrude radially outward at the rear of the chuck connection portion 11*a*. The pair of anvil pawls 11*b* are arranged at intervals of 180 degrees when the chuck connection portion 11*a* is viewed in the axial direction. The pair of anvil pawls 11*b* are formed so as to be integrated with the chuck connection portion 11*a*. In the anvil 11, the front side of the pair of anvil pawls 11*b* is supported on the casing body 16 by a washer 51 interposed therebetween. The chuck connection portion 11*a* of the anvil 11 has its outer circumference rotatably supported by a bearing 52. Thus, the anvil 11 is supported so as to be rotatable relative to the casing body 16.

As illustrated in FIG. 1, an insertion hole 11*c* that allows a bit to be inserted thereinto is formed in the chuck connection portion 11*a* of the anvil 11. The bit inserted into the insertion hole 11*c* is fixed by the chuck 12.

As illustrated in FIG. 1, the chuck 12 includes a cylindrical chuck body 12*a*, a spring 12*b* that is disposed on the inner circumference of the chuck body 12*a* and that urges the chuck body 12*a* rearward, and multiple steel balls 12*c* disposed in holes formed in the chuck connection portion 11*a*. The chuck body 12*a* includes protuberances 12*d* for pushing the steel balls 12*c* toward the inside of the chuck connection portion 11*a* while a bit is in a fixed position (in the state illustrated in FIG. 1). When the steel balls 12*c* are pushed into the inside of the chuck connection portion 11*a* using the protuberances 12*d*, the bit inserted into the insertion hole 11*c* of the chuck connection portion 11*a* can be fixed with the steel balls 12*c*. The protuberances 12*d* are disposed so as to be spaced apart from the steel balls 12*c* when the chuck body 12*a* is moved forward by sliding. Thus, when the chuck body 12*a* is moved forward by sliding, the steel balls 12*c* are no longer urged by the protuberances 12*d* toward the inside of the chuck connection portion 11*a* and thus move away from the chuck connection portion 11*a*. Thus, the bit is allowed to be easily detached from the insertion hole 11*c* of the chuck connection portion 11*a*.

Rotation Impact Operation

The following describes an operation of the impact driver 1 having the above-described configuration for exerting a rotation and an impact on a bit fixed to the anvil 11.

When the motor 2 rotates, the sun gear 22 of the planetary gear mechanism 21 is rotated by the output shaft 2*a* of the motor 2. Following the rotation of the sun gear 22, the planetary gears 23 are rotated relative to the internal gear 24. Thus, the planetary gears 23 move inside the internal gear 24 and, accordingly, the spindle 30 is rotated by the pins 25 that support the planetary gears 23.

When the spindle 30 rotates, the main hammer 43 is rotated together with the spindle 30 with the steel balls 42 interposed therebetween. Following the rotation of the main hammer 43, the pair of hammer pawls 43*f* of the main hammer 43 come into contact with the anvil pawls 11*b* of the anvil 11. Then, the anvil 11 is also rotated together with the main hammer 43 (see the arrow in FIG. 5). Thus, the bit attached to the anvil 11 by the chuck 12 rotates and exerts a rotational force on a bolt or a nut. In this manner, initial fastening of a bolt or a nut can be performed.

When the load exerted from the bit on the anvil 11 increases after fastening of a bolt or a nut, the spindle 30 rotates relative to the main hammer 43 and the steel balls 42 disposed between the main hammer 43 and the spindle 30 move. Then, the main hammer 43 moves rearward in the axial direction relative to the spindle 30 and the main hammer 43 compresses the spring 44. When the main hammer 43 arrives at a predetermined position in the axial direction relative to the spindle 30, the pair of hammer pawls 43*f* of the main hammer 43 and the anvil pawls 11*b* of the anvil 11 become disengaged from one another.

When the pair of hammer pawls 43*f* of the main hammer 43 and the anvil pawls 11*b* of the anvil 11 become disengaged from one another in this manner, the main hammer 43 rotates while moving to the front of the impact driver 1 due to the resilience of the compressed spring 44. Thus, the pair of hammer pawls 43*f* of the main hammer 43 impact the anvil pawls 11*b* of the anvil 11 and exert a rotational impact force on the anvil 11.

At this time, the secondary hammer 45 rotating together with the main hammer 43 can enhance the rotational impact force exerted on the anvil 11. Specifically, the secondary hammer 45 rotates together with the main hammer 43. Thus, when the main hammer 43 rotates while moving to the front of the impact driver 1 due to the resilience of the spring 44 in the above-described manner, the rotational moment of inertia of the main hammer 43 is increased. On the other hand, the secondary hammer 45 does not move in the axial direction of the spindle 30 and allows the main hammer 43 to move relative to the secondary hammer 45. Thus, the force of inertia exerted when the main hammer 43 moves in the axial direction of the spindle 30 is not increased.

Thus, the secondary hammer 45 having the configuration according to the embodiment can enhance a rotational impact force of the main hammer 43. In addition, the secondary hammer 45 is formed in a cylinder having a larger inner diameter and a larger outer diameter than the main hammer 43, so that a large moment of inertia can be produced by a compact configuration.

The secondary hammer 45 having the configuration according to the embodiment can prevent a large impact from being exerted on the anvil 11 in the axial direction of the spindle 30 via the main hammer 43. Thus, vibrations that do not contribute to a force for fastening a bolt or a nut can be reduced.

By repeating the above-described operation, a rotational impact force is repeatedly exerted on the anvil 11.

In the configuration according to the embodiment, the pins 46 that support the secondary hammer 45 so as to allow the secondary hammer 45 to rotate together with the main hammer 43 have their end portions on the first side in the axial direction supported by the large diameter portion 32 of the spindle 30 and have their end portions on the second side in the axial direction supported by the outer circumferential surface of the main hammer 43. This configuration dispenses with a bearing for supporting the secondary hammer 45, whereby the impact driver 1 can be formed in a small size. Moreover, since the secondary hammer 45 is supported by the pins 46 from the inner side in the radial direction, the outer diameter of the secondary hammer 45 can be increased as much as possible, whereby the moment of inertia of the secondary hammer 45 can be increased. Thus, the rotational impact force exerted on the anvil 11 in the rotational direction can be ensured, so that the impact driver 1 can be formed in a small size without a reduction of the fastening torque.

Second Embodiment

Figure 6:
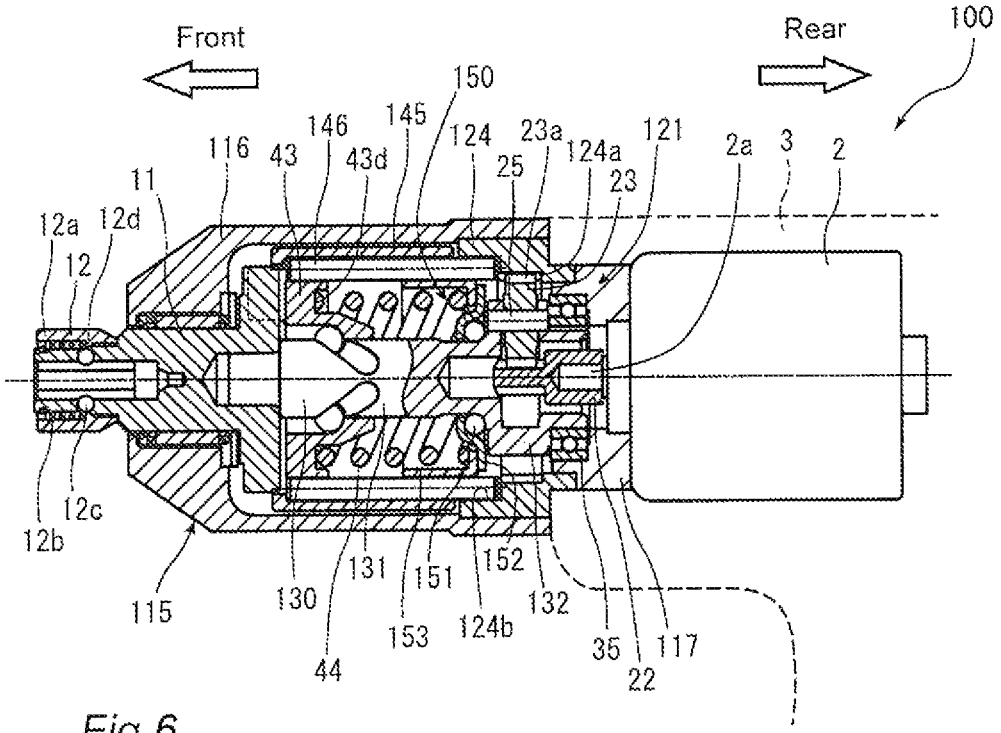
FIG. 6 is a cross-sectional view of a schematic configuration of an impact driver according to a second embodiment.

FIG. 6 illustrates a schematic configuration of an impact driver 100 serving as a rotary tool according to a second embodiment of the invention. This embodiment differs from the first embodiment in terms of the configuration of a secondary hammer 145. In the following description, components that are the same as those according to the first embodiment are denoted by the same reference symbols and not described. Also in FIG. 6, only a driving portion of the impact driver 100 is illustrated and illustrations of other components are omitted. Also in the following description, the left side in FIG. 6 is referred to as the front of the impact driver (or, simply, the front) and the right side in FIG. 6 is referred to as the rear of the impact driver (or, simply, the rear).

A planetary gear mechanism 121 that transmits a rotational force output from the output shaft 2*a* of the motor 2 to a spindle 130 includes a sun gear 22 and planetary gears 23, which have configurations similar to those according to the first embodiment, and an internal gear 124, which receives pins 146, described below, on the inner circumference. The internal gear 124 is a cylindrical member and has internal teeth 124*a* on the inner circumferential surface at the rear and a pin receiving portion 124*b* on the inner circumferential surface at the front. The internal teeth 124*a* engage with the external teeth 23*a* of the planetary gears 23 and the pin receiving portion 124*b* receives the pins 146. The outer circumferential surface of the internal gear 124 is in contact with the inner circumferential surface of a casing body 116 of a casing 115. As illustrated in FIG. 6, the casing 115 includes a casing cover 117.

As in the case of the spindle 30 according to the first embodiment, the spindle 130 includes a small diameter portion 131 and a large diameter portion 132. The large diameter portion 132 is located at the rear of the small diameter portion 131 and is formed so as to be integrated with the small diameter portion 131. At a connection portion between the large diameter portion 132 and the small diameter portion 131, a spring holding mechanism 150 that holds the spring 44 for elastically supporting the main hammer 43 is disposed.

The spring holding mechanism 150 includes multiple steel balls 151, a ring 152 that presses the steel balls 151 against the large diameter portion 132 of the spindle 130, and a flange portion 145*a* of the secondary hammer 145, described below.

Figure 7:
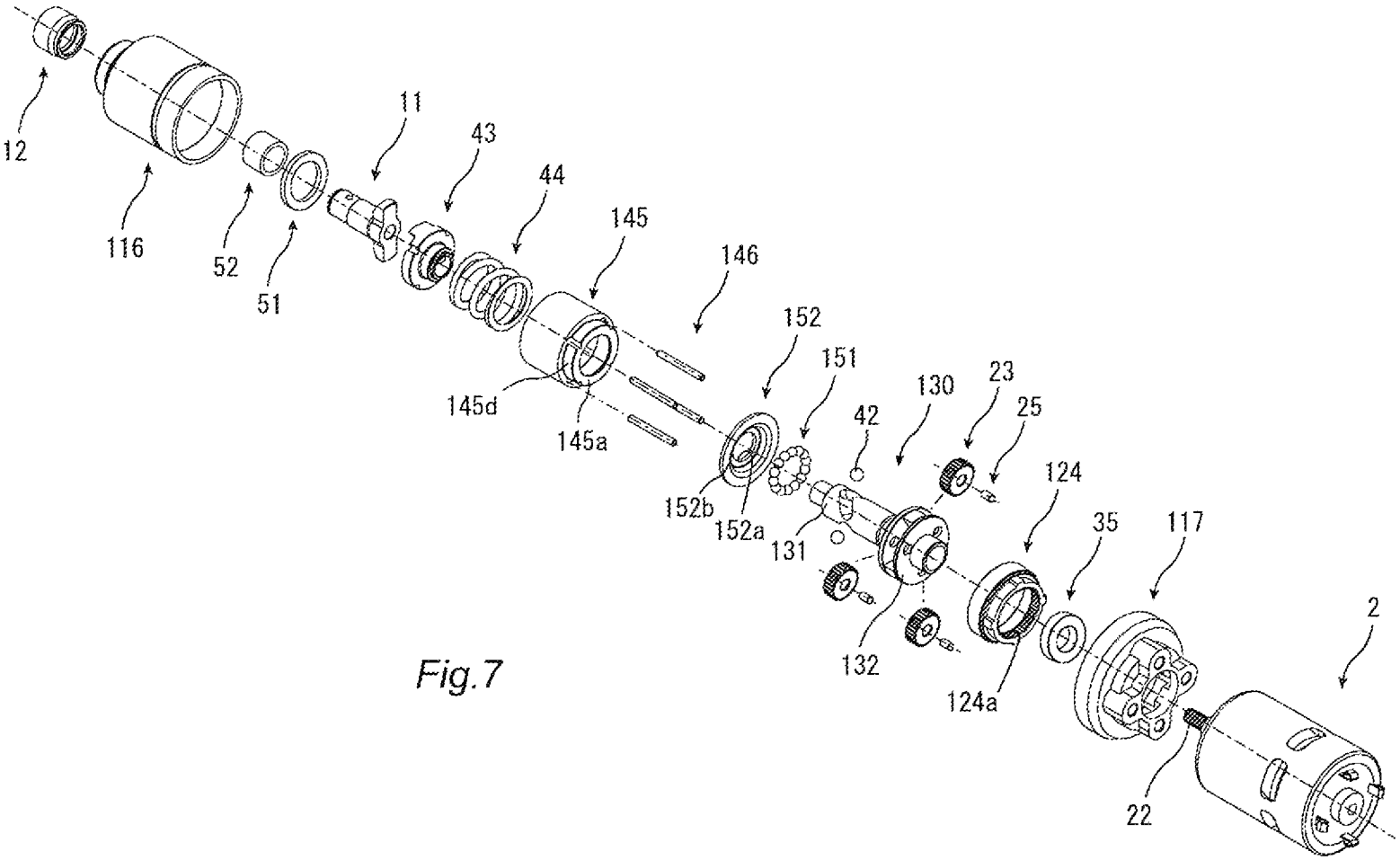
FIG. 7 is an exploded perspective view in which components of a driving portion of the impact driver according to the second embodiment are illustrated in an exploded manner.

As illustrated in FIG. 7, the ring 152 is formed in a doughnut shape having a through hole 152*a* at the center so as to allow the small diameter portion 131 of the spindle 130 to pass therethrough. The ring 152 has, on its inner circumferential side, a bent portion 152*b* on which the steel balls 151 can be disposed. The ring 152 having such a configuration allows the multiple steel balls 151 to be rotatably pressed against a connection portion between the small diameter portion 131 and the large diameter portion 132 of the spindle 130. Thus, the ring 152 is disposed so as to be rotatable relative to the spindle 130 by the multiple steel balls 151.

Figure 8:
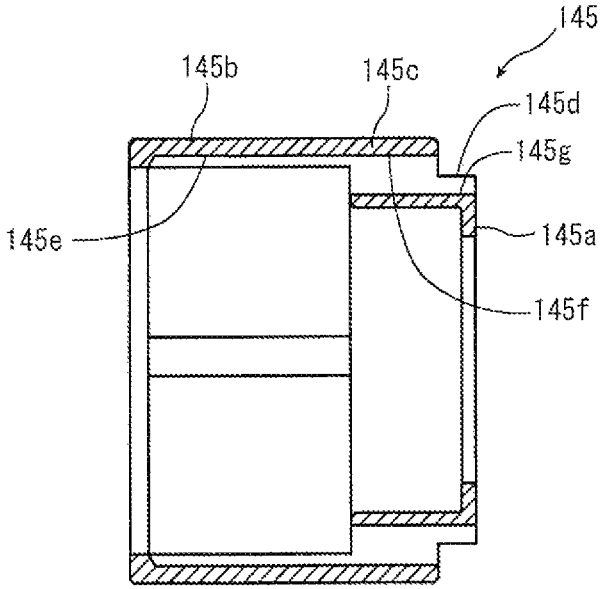
FIG. 8 is a cross-sectional view of a schematic configuration of a secondary hammer of the impact driver according to the second embodiment.

As illustrated in FIG. 6 to FIG. 8, a flange portion 145*a* of the secondary hammer 145 is disposed at the rear of the cylindrical secondary hammer 145 so as to protrude inward. This flange portion 145*a* is disposed so as to support a first end portion of the spring 44 and so as to touch the outer circumference of the ring 152 (see FIG. 6). Thus, the spring 44 and the secondary hammer 145 are supported by the ring 152 rotatable relative to the spindle 130, whereby the spring 44 can be prevented from rotating even when the spindle 130 rotates.

A second end portion of the spring 44 is disposed in the groove 43*d* formed in the main hammer 43.

The pins 146 have an axial length longer than the axial length of the secondary hammer 145. Thus, as described below, the pins 146 protrude outward beyond the secondary hammer 145 in the state where the pins 146 are disposed on the secondary hammer 145. Except for the axial length, the pins 146 have the same configuration as the pins 46 according to the first embodiment.

The secondary hammer 145 is a substantially cylindrical member made of steel. An end portion of the secondary hammer 145 on the first side in the axial direction has a smaller inner diameter than an end portion of the secondary hammer 145 on the second side in the axial direction. Specifically, as illustrated in FIG. 8, the secondary hammer 145 includes a thin portion 145*b* located near the end portion on the second side and a thick portion 145*c* located near the end portion on the first side. The secondary hammer 145 also has a small diameter portion 145*d*, which has a smaller outer diameter than the other portions, at the end portion on the first side, that is, at the end portion of the thick portion 145*c*. At the end portion of the small diameter portion 145*d*, the above-described flange portion 145*a* is disposed.

Guide grooves 145*e* are formed in the inner circumferential surface of the thin portion 145*b* of the secondary hammer 145. Guide holes 145*f* continuous with the guide grooves 145*e* are formed in the thick portion 145*c* of the secondary hammer 145. Specifically, the guide holes 145*f* pass through the thick portion 145*c*. Guide grooves 145*g* continuous with the guide holes 145*f* are formed on the outer circumferential surface of the small diameter portion 145*d* of the secondary hammer 145. Here, the guide grooves 145*e* are not formed at the end portion of the secondary hammer 145.

These guide grooves 145*e* and 145*g* and the guide holes 145*f* enable holding of the pins 146. Specifically, the pins 146 are held by the secondary hammer 145 in the guide grooves 145*e* and 145*g* in the state of passing through the guide holes 145*f*, that is, in the state of protruding axially outward beyond the openings of the guide holes 145*f*. The pins 146 have their first end portions (on the second side of the axial direction of the spindle 130) supported by the outer circumferential surface of the main hammer 43 and have their second end portions (on the first side of the axial direction of the spindle 130) supported by the pin receiving portion 124*b* of the internal gear 124 of the planetary gear mechanism 121. As described above, since the outer circumferential surface of the internal gear 124 touches the inner circumferential surface of the casing body 116 of the casing 115, the second end portions of the pins 146 are supported by the casing 115.

In this configuration, the guide holes 145*f*, which are through holes, are formed in the secondary hammer 145, the pins 146 are held in the guide holes 145*f* and the guide grooves 145*e* and 145*g*, and the end portions of the pins 146 are supported by the main hammer 43 and the pin receiving portion 124*b* of the internal gear 124. This configuration thus enables supporting of the secondary hammer 145 without using a bearing or other devices. Thus, the size of the configuration of the impact driver 100 can be reduced further than in the case of the size of the configuration in which the secondary hammer 145 is supported using a bearing or other devices.

By supporting the secondary hammer 145 using the pins 146 supported by the main hammer 43 and the internal gear 124 in the above-described manner, the secondary hammer 145 can be held in such a manner that the axis of the secondary hammer 145 is not deviated to a large extent from the axis of the spindle 130 even when the secondary hammer 145 is deformed due to a heat treatment such as quenching during a process of manufacturing the secondary hammer 145. Specifically, a structure for supporting the secondary hammer 145 according to this embodiment enables accurate positioning of the secondary hammer 145 with respect to the spindle 130.

The following configurations are preferable in the configurations according to the above-described first and second embodiments.

The pins 46 or 146 preferably have an axial length that is longer than or equal to the axial length of the secondary hammers 45 or 145. This configuration facilitates supporting of part of the pins 46 or 146 in the radial direction of the pins 46 or 146 using at least one of the spindle 30 or the casing 15 or 115.

At least three pins 46 or 146 are preferably disposed in the circumferential direction on the outer circumferential surface of the main hammer 43. This configuration enables stable supporting of the secondary hammer 45 or 145 on the main hammer 43 using the pins 46 or 146. Specifically, supporting the secondary hammer 45 or 145 at at least three points on the main hammer 43 enables more reliable support of the secondary hammer 45 or 145 in such a manner that the main hammer 43 is prevented from touching the inner surface of the secondary hammer 45 or 145. Thus, the rotation of the main hammer 43 can be stably transmitted to the secondary hammer 45 or 145 and, concurrently, the main hammer 43 and the secondary hammer 45 or 145 are allowed to stably move relative to each other.

The end portions of the pins 46 on the first side in the axial direction are preferably positioned between the secondary hammer 45 and the spindle 30. This configuration allows the rotation axis of the secondary hammer 45 and the rotation axis of the spindle 30 to easily and reliably coincide with each other using the pins 46.

The spindle 30 preferably includes a large diameter portion 32, which is disposed at the end portion on the first side in the axial direction and causes the pins 46 to be interposed between itself and the inner surface of the secondary hammer 45, and a small diameter portion 31, which is disposed at the end portion on the second side in the axial direction so as to allow the main hammer 43 to rotate together with the spindle 30 and move in the axial direction relative to the spindle 30.

This configuration enables supporting of the pins 46 using the large diameter portion 32 of the spindle 30 and allows the main hammer 43 to move in the axial direction in the small diameter portion 31 of the spindle 30. This configuration thus allows the rotation axis of the secondary hammer 45 and the rotation axis of the spindle 30 to coincide with each other and the main hammer 43 to move in the axial direction relative to the spindle 30.

The above-described configuration enables supporting of the end portions of the pins 46 on the first side in the axial direction using the large diameter portion 32 of the spindle 30, whereby the configuration in which the secondary hammer 45 is supported from the inner side in the radial direction can be easily attained.

Example

Impact drivers having the configuration according to the above-described first embodiment were prototyped and subjected to actual performance evaluation tests. Examples 1 and 2 show the test results obtained from the cases where impact drivers having the same configuration as the first embodiment were tested. Existing Examples 1 and 2 show the test results obtained from the cases where commercially available impact drivers were tested. Each of the impact driver according to Existing Examples 1 and 2 does not include a secondary hammer and includes only a main hammer.

The performance evaluation test included a measurement of the rotation speed of the anvil, a measurement of the bolt fastening torque, and a measurement of the current value.

In the measurement of the rotation speed of the anvil, the maximum value was measured by a revolution indicator when the anvil was rotated for 30 seconds or longer in the normal direction (rightward when viewed from the rear of the impact driver) and in the reverse direction (leftward when viewed from the rear of the impact driver).

The bolt fastening torque was measured using a bolt axial force meter. Specifically, the values were read which were indicated on a bolt axial force meter when a bolt and a nut were fastened using a torque wrench at 100 N·m, 200 N·m, and 300 N·m after grease had been applied to the bolt and the nut. The values equivalent to torque were calculated from these read values. Then, the values were read which were indicated on the bolt axial force meter in the state where the bolt and the nut had been fastened by the impact driver and the fastening torque was acquired from the value equivalent to torque calculated in advance.

A motor current was measured as the current value. In each of the above-described measurement, the maximum value of the motor current was measured by an ammeter.

Table 1 shows the performance evaluation test results of Examples 1 and 2 and Existing Examples 1 and 2. In Table 1, the moment of inertia was acquired from the sum total of the moments of inertia of the main hammer, the secondary hammer, and the pins disposed between the main hammer and the secondary hammer.

TABLE 1

| | Moment of Inertia ($kg \cdot mm^2$) | Rotational Speed (rpm) Normal Rotation | Rotational Speed (rpm) Reverse Rotation | Fastening Torque (Nm) | Current (A) | Efficiency (Nm/A) |
|---|---|---|---|---|---|---|
| Example 1 | 47.4 | 2130 | 2110 | 253 | 21.1 | 12.0 |
| Example 2 | 47.4 | 2180 | 2220 | 301 | 22.5 | 13.4 |
| Existing Example 1 | 32.6 | 3570 | 3820 | 383 | 37.4 | 10.2 |
| Existing Example 2 | 38.6 | 2530 | 2460 | 228 | 21.3 | 10.7 |

As illustrated in Table 1, in the configurations of Examples 1 and 2, the moment of inertia is larger than that in the case of the configurations of Existing Examples 1 and 2. Thus, an equivalent fastening torque is produced at a rotation speed lower than the rotation speed in the case of Existing Examples 1 and 2. Specifically, in the configurations of Examples 1 and 2, a higher or equivalent fastening torque was produced at the current value lower than the current value in the case of the configurations of Existing Examples 1 and 2. Thus, the configurations of Examples 1 and 2 can more efficiently produce a fastening torque than the configurations of Existing Examples 1 and 2.

From the above-described test results, the configuration according to the first embodiment efficiently produces a fastening torque equivalent to that in the case of an existing configuration at a current smaller than that in the case of the existing configuration, whereby it was found that the configuration according to the first embodiment successfully attains an impact driver achieving a higher performance than an existing impact driver.

Other Embodiments

Heretofore, the embodiments of the invention have been described. The above-described embodiments, however, are mere examples for embodying the invention. Thus, the invention is not limited to the above-described embodiments and may be appropriately embodied by modifying the above-described embodiments within a scope not departing from the gist of the invention.

In each of the embodiments, the impacting mechanism 40 exerts a rotational impact force on the anvil 11 using the main hammer 43 by moving the main hammer 43, elastically supported by the spring 44, in the axial direction utilizing the rotation of the spindle 30 and using the cam grooves 41 and the steel balls 42. However, the impacting mechanism may have other configurations as long as it can exert a rotational impact force on the anvil 11.

In each of the embodiments, four pins 46 or 146 are arranged in the circumferential direction between the main hammer 43 and the secondary hammer 45 or 145. However, any number of pins may be arranged between the main hammer 43 and the secondary hammer 45 or 145 as long as the number is greater or equal to three.

In each of the embodiments, the motor 2 is used as a driving power source for rotating the spindle 30 or 130. However, any device other than the motor may be used as the driving power source as long as it can rotate the spindle 30 or 130.

In each of the embodiments, the configuration of the embodiment is employed in the impact driver. However, the configuration of the embodiment may be employed in a device other than the impact driver, such as an impact wrench, as long as it exerts a rotational impact force.

In the second embodiment, the pins 146 are longer than the secondary hammer 145 and protrude rearward beyond the secondary hammer 145. However, the pins may be shorter than the secondary hammer and may be formed so as not protrude rearward beyond the secondary hammer.

In the second embodiment, the pins 146 have their first end portions radially supported by the main hammer 43 and have their second end portions radially supported by the casing 115. However, the first end portion of each pin 146 may be radially supported by the casing 115 or a member disposed on the casing 115. In addition, the second end portion of each pin 146 may be radially supported by the spindle 130. Alternatively, the second end portion of each pin 146 may be radially supported by the spindle 130 and the casing 115 (including a member supported by the casing 115).

The present invention is usable in a rotary tool that exerts a rotational impact force for fastening a bolt and a nut, such as an impact driver or an impact wrench.

What is claimed is:

1. A rotary tool, comprising:

a driving power source;

a spindle formed in a columnar shape extending to a first side of an axial direction, the spindle being rotated by an output from the driving power source;

a main hammer including a hammer pawl protruding to a second side of the axial direction, the main hammer being fitted to an end portion of the spindle on the second side of the axial direction so as to be rotatable together with the spindle and movable in the axial direction relative to the spindle;

an anvil including an anvil pawl engageable with the hammer pawl, the anvil being disposed on the end portion of the spindle on the second side of the axial direction in such a manner that a rotation axis of the anvil is aligned with a rotation axis of the spindle;

a cylindrical secondary hammer disposed so as to cover an outer circumference of the main hammer;

a round-columnar pin having an end portion on the second side of the axial direction positioned between the main hammer and the secondary hammer so as to allow the secondary hammer to rotate together with the main hammer and allow the main hammer and the secondary hammer to move in the axial direction relative to each other;

an impacting mechanism disposed on the spindle so as to support the main hammer, the impacting mechanism exerting an impact in a rotational direction on the anvil pawl of the anvil using the hammer pawl of the main hammer by moving the main hammer in the axial direction while rotating the main hammer when a load torque having a predetermined value or higher is applied to the main hammer; and a casing that accommodates the spindle, the main hammer, the secondary hammer, the anvil, the pin, and the impacting mechanism, wherein at least one of end portions of the pin in the axial direction is supported in a radial direction of the pin by at least one of the spindle or the casing in such a manner that a rotation axis of the secondary hammer coincides with the rotation axis of the spindle.

2. The rotary tool according to claim 1, wherein the pin touches the secondary hammer only at an inner surface of the secondary hammer and is held by the main hammer and the spindle from an inner side of a radial direction of the secondary hammer.

3. The rotary tool according to claim 2, wherein the secondary hammer includes a thick portion on the first side of the axial direction, wherein the thick portion has a through hole that allows the end portion of the pin on the first side of the axial direction to pass therethrough, and wherein, in the state where the end portion of the pin on the first side of the axial direction passes through the through hole, the pin protrudes outward in the axial direction beyond an opening of the through hole and the pin is supported by at least one of the casing or the spindle in the radial direction of the pin.

4. The rotary tool according to claim 1, wherein the secondary hammer includes a thick portion on the first side of the axial direction, wherein the thick portion has a through hole that allows the end portion of the pin on the first side of the axial direction to pass therethrough, and wherein, in the state where the end portion of the pin on the first side of the axial direction passes through the through hole, the pin protrudes outward in the axial direction beyond an opening of the through hole and the pin is supported by at least one of the casing or the spindle in the radial direction of the pin.

* * * * *